United States Patent [19]

Hardesty et al.

[11] Patent Number: 4,522,459

[45] Date of Patent: Jun. 11, 1985

[54] SYSTEMS FOR AND METHODS OF MAKING ELECTRICAL CONNECTIONS

[75] Inventors: Edwin C. Hardesty, Perry Hall; Erle M. Hutchins, Bel Air, both of Md.

[73] Assignee: AT&T Technologies, Inc., Berkeley Heights, N.J.

[21] Appl. No.: 615,690

[22] Filed: Jun. 1, 1984

Related U.S. Application Data

[63] Continuation of Ser. No. 331,731, Dec. 17, 1981, abandoned.

[51] Int. Cl.[3] ..... H01R 13/39

[52] U.S. Cl. ..... 339/98

[58] Field of Search ..... 339/97 R, 97 P, 98, 339/99 R

[56] References Cited

U.S. PATENT DOCUMENTS

| | | | |
|---|---|---|---|
| 3,599,172 | 8/1971 | Tuchto | 339/98 |
| 3,708,779 | 1/1973 | Enright et al. | 339/99 R |
| 3,842,392 | 10/1974 | Aldridge | 339/99 R |
| 3,955,873 | 5/1976 | Peterson | 339/99 R |
| 4,066,317 | 1/1978 | Bierenfeld et al. | 339/98 |
| 4,141,618 | 2/1979 | Reavis, Jr. et al. | 339/97 P |
| 4,269,466 | 5/1981 | Huber | 339/97 R |
| 4,283,105 | 8/1981 | Ferrill et al. | 339/97 R |
| 4,354,719 | 10/1982 | Weidler | 339/99 R |

*Primary Examiner*—Joseph H. McGlynn
*Attorney, Agent, or Firm*—E. W. Somers

[57] ABSTRACT

A connector system of this invention is used to splice conductors of at least two groups. The system includes a base (60) having a plurality of tubular, rigid metallic contact elements (62—62) positioned in apertures (110—110) that are formed in two rows along the base. Each aperture falls in an associated groove of a plurality of parallel grooves formed transversely of the rows of the apertures. Conductors (51—51) of a first group are positioned in the grooves of the base. Then, the base is provided with a cover and the contact elements are moved in their apertures to cause the conductors to be moved into slots in the contact elements, to penetrate the cover and to sever excess end portions of the conductors. The walls of the slots are adapted to establish electrical engagement with the conductors that are moved thereinto. The cover is removed, and a carrier having a plurality of grooves in which are positioned conductors of a second group that are to be spliced to the first is assembled to the base. Relative motion is caused to occur between the contact elements and the carrier to cause the conductors of the second group to be moved into the slots of the contact elements whereby electrical engagement between the two groups is established.

18 Claims, 36 Drawing Figures

SYSTEMS FOR AND METHODS OF MAKING ELECTRICAL CONNECTIONS

This is a continuation-in-part of application Ser. No. 331,731, filed Dec. 17, 1981, abandoned.

TECHNICAL FIELD

This invention relates to systems for and methods of making electrical connections, and more particularly, to a connector which is used to splice a plurality of insulated conductors of communications cables.

BACKGROUND OF THE INVENTION

Electrical connections for splicing together pluralities of insulated conductors for telecommunications have been made in a number of ways with connectors that are available in the marketplace. One of these is by way of terminals which include a post and nut arrangement. In those, an end of an insulated conductor is bared and wrapped about a threaded post with a nut being turned along the post to engage the conductor end and to hold it in engagement with a terminal block from which the post extends. Typically, an opposite end of the post is formed to have another conductor wrapped thereabout. While this arrangement results in a reliable connection, it is labor intensive and escalates costs.

Connectors are also available which do not require the stripping of the insulation from an end of the conductor prior to making the connection. A connector which is widely used in telecommunications for interconnecting insulated conductors in which the conductive elements are solid is one which includes split beam contact elements. The contact element, in one well-known product, includes a center portion with beams extending colinearly therefrom. Each of the beams is bifurcated with the furcations of each forming a conductor-receiving slot. A plurality of the split beam contact elements are mounted in a dielectric housing which may be called a terminal block. To establish a connection, an insulated conductor is moved into one slot and another conductor into the opposite slot. Surfaces that define the entrances to the slots and the slots themselves are configured to engage the conductive element of each conductor to establish an electrical connection between the conductors. See for example U.S. Pat. No. 3,496,522 which issued on Feb. 17, 1970 in the names of B. C. Ellis et al and U.S. Pat. Nos. 3,611,264 and 3,772,635.

A connector system which includes the split beam contact element is disclosed and claimed in U.S. Pat. No. 3,858,158 which issued on Dec. 31, 1974 in the names of R. W. Henn et al. and lowers significantly the cost of making connections. The above-identified connector system includes an elongated index strip for holding a plurality of insulated conductors of a first cable in a spaced array and a connector module which includes a plurality of split beam type metallic contact elements. When the connector module is assembled to the index strip, end portions of the contact elements become electrically connected to the conductors held in the index strip. Afterwards, conductors from a second cable are assembled to the connector module so that the opposite end portions of the contact elements are electrically connected to them and hence to the conductors of the first cable. In E. W. Becker et al U.S. Pat. No. 4,148,138 which issued Apr. 10, 1979, a tool is shown for assembling corresponding pluralities of insulated conductors of cable ends to this type connector to electrically interconnect the conductors.

One problem with the split beam contact elements relates to the capability of using one slot to terminate two or more conductors or conductors of different guages. When the insulated conductor first placed in the slot is moved farther inwardly, it tends to spread apart the side walls of the furcations which define the slot and which in prior art connectors are generally resilient. Disadvantageously, the surfaces which define the slot can be deflected to an extent that precludes the establishment and maintenance of a satisfactory gastight connection with the conductive element of a second conductor that is moved into the slot. The resilience of the furcations also presents a problem when attempting to connect conductors of a range of gauge sizes. A solution to this problem is to maintain an inventory of different connectors for use with different gauge size cables, but this would increase costs.

For the same reason, the conventional split beam connector does not provide an altogether effective connective mechanism for stranded conductors. When a stranded conductor is moved into the slot, the furcations which are resilient are deflected. The configuration of the conductor is deformed and the individual strand elements become rearranged in the slot with some diminution of the nicking of the elements.

Another concern which is a continuing one in the connector art relates to compactness. Because of the number of conductor pairs in presently used cables, a relatively large number of the connector systems such as those disclosed in the above-identified Henn et al patent are required to complete a splice. Each of these systems, which is designed to splice twenty-five pairs of insulated conductors, has a length of about eight inches, a width of about a quarter of an inch and a height of about one and one half inches. Multiply these dimensions by the number of twenty-five pair splices in one of the large pair size cables and it becomes readily apparent that a closure therefor must be substantial in size. The connector system should be as small as possible not only for reasons of material costs, but also to reduce the space required in manholes, vaults, and closures.

Economy of space has been achieved to some extent by the system disclosed in the Henn et al patent and by a connector such as one shown in U.S. Pat. No. 3,708,779. Therein the connections are made also by split beam contact elements but they are arranged in rows and are staggered as between rows to reduce their center-to-center spacing.

Most, if not all the splicing type connectors which are available commercially include provisions for severing end portions of the conductors which extend beyond the connection element such as, for example, the split beam contact element. In the Henn et al connector, an anvil surface is provided for supporting the end portions of the conductors to facilitate their severance by the blade of a tool such as that disclosed in the Becker et al patent. In the connector shown in U.S. Pat. No. 3,708,779, cut-off blades are mounted in one of the plastic elements of the system. When the elements are assembled together, the blades sever the end portions of the conductors which extend beyond the split beam connections.

Another problem relates to the accuracy of and the testing for connections. Typically, a test is made which determines only the correctness of a pair sequence along the connector. Although the conductor pairs may be connected along the connector in the correct sequence, the conductors of one or more pairs, which are color coded, may be reversed. As a result, the conductor of one pair in one slot of a split beam contact element may not be the correct one for connection to a conductor of another pair in the other slot of the contact element. This incorrect association of spliced conductors may be overcome by visual inspection. However, with the prior art connector systems, the conductors which are spliced together are generally supported in stacked plastic connector elements. Because of this arrangement, the conductors to be spliced together are spaced apart which makes paired identification before connection somewhat difficult.

What is needed is a multi-conductor connection system which is capable of establishing and maintaining suitable electrical connections with stranded or solid-wire-like conductors. Further, it should be able to establish and maintain electrical engagement with one or more conductors of the same or different gauge size. With today's seemingly endless growth of telecommunications, there is still a need for an electrical connector that is relatively small and that fills the above needs and which retains the advantages of the split beam contact element such as its bilateral connectorability. It would also be most desirable to provide a system which facilitates improved visual inspection or verification either in the factory or in the field.

Lengths of communications cables are connected together in the field at splice locations, such as in manholes or overhead adjacent to poles. That such an operation is expensive should be apparent when considering the environment in which the splice is made. In order to reduce the effort required in such environments, there has been a trend toward factory connectorization of cables. Preconnectorized cable ends are simply assembled together in the field with simultaneous connections being made between all the conductors assembled to one connector element and then connected to another element. A connector system which meets the needs described hereinbefore should also be one which preserves the capability of being used in the factory to connectorize cable ends prior to shipment.

SUMMARY OF THE INVENTION

The foregoing needs of the connector art have been met by the system and the methods of this invention. The system for interconnecting corresponding conductors of communications cables comprises a base which is made of a dielectric material and which includes a plurality of spaced parallel conductor-receiving grooves formed across one surface thereof. The base has a plurality of apertures formed therein transverse of the grooves and in a plurality of rows which also are transverse to the grooves. The apertures in said rows are staggered with respect to each other with each of the apertures communicating with one of the grooves. A contact element which is made of an electrically conductive material is positioned within each of the apertures for establishing an electrical connection between conductors. The contact element comprises a tubular member having at least one open end and having surfaces that define a conductor-receiving slot which extends longitudinally from the open end and which is aligned with the groove of the base which communicates with the aperture in which the contact element is positioned. The slot is configured and the tubular member has sufficient stiffness to cause at least portions of the surfaces that define the slot to nick each of one or more conductors that are caused to be moved into and along the slot with any accompanying deflection of the surfaces being substantially negligible.

The system also includes a plastic member which is capable of being mated with the base to cover the grooves. Through relative motion between the contact elements and the plastic cover, conductors which are aligned with a groove are caused to be moved into the conductor-receiving slot of the contact element which is positioned in the aperture that communicates with the groove. Also, as a result of the relative motion, the free end of each contact element is caused to become embedded in the plastic cover.

In a preferred embodiment, the cover is assembled to the base to enclose temporarily conductors of a first group, one each of which occupies a groove in the base. Each contact element is formed so that its conductor-receiving end has a beveled portion to sever the end portion of the conductor as it is moved over the conductor. As the contact elements are driven through first incremental distances into the cover, they establish an electrical connection with the conductors and sever the end portions. Subsequently, the cover is removed to allow assembly of a carrier with the base.

The carrier has a plurality of grooves formed across a surface that is mated with the grooved surface of the base. One conductor of a second group is placed in each groove in the carrier and over a bridge within the groove to facilitate connection with an associated conductor of the first group when the carrier is assembled to the base.

When the carrier is secured to the base, the contact elements are moved through a second incremental distance and into the carrier. Each conductor of the first group is moved farther into the conductor-receiving slot of its associated contact elements. The end of the contact element is moved over the bridge to cause the end portion of the second conductor to be severed and to cause the conductor of the second group to be moved into the entry and then an interior portion of the slot of the contact element. This establishes an electrical connection between those conductors of the two groups which are disposed within the slot of a contact element.

Advantageously, severance of the end portions of the conductors is accomplished without the use of separate tools or blades separate and apart from the contact elements. Also, the size of the contact elements and hence of the system is considerably reduced over that of other systems that are known to the art.

BRIEF DESCRIPTION OF THE DRAWINGS

Other features of the present invention will be more readily understood from the following detailed description of specific embodiments thereof when read in conjunction with the accompanying drawings, in which.

DETAILED DESCRIPTION OF THE INVENTION

Figure 1:
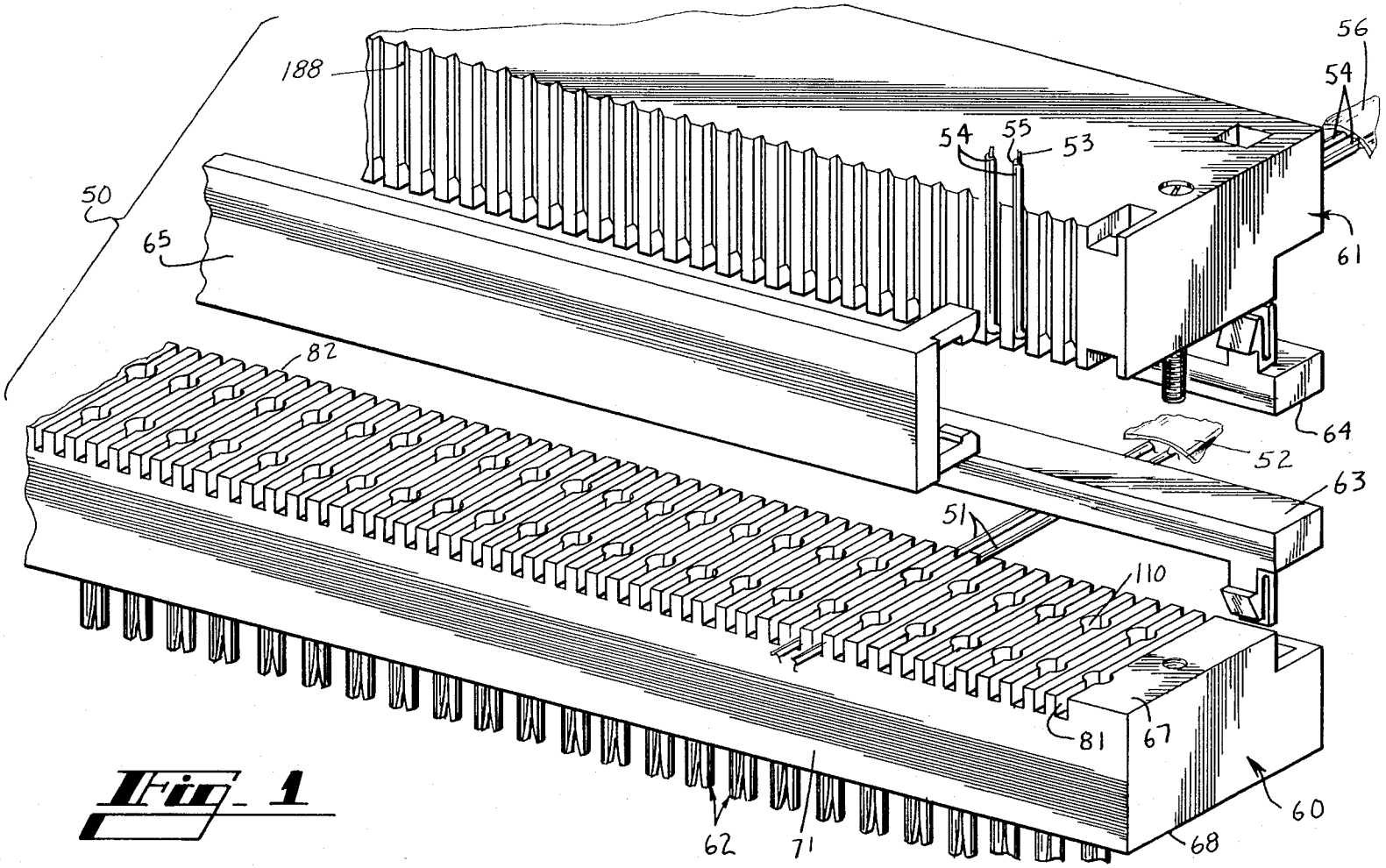
FIG. 1 is a perspective view of a connector system of this invention for connecting electrically conductors of a first cable to corresponding conductors of a second cable.

Referring now to FIG. 1, there is shown a connector system of this invention, said system being designated generally by the numeral 50. The system 50 is adapted to interconnect a plurality of insulated conductors 51—51 of a first cable 52 with a plurality of insulated conductors 54—54 of a second cable 56. Each insulated conductor includes a conductive element 53 and an insulative cover 55.

The connector system 50 includes a base which is designated generally by the numeral 60 and a carrier which is designated generally by the numeral 61. For connectorization, the conductors 51—51 are positioned in the base 60.

The base 60 mounts a plurality of metallic contact elements 62—62 which are adapted to establish electrical contact with conductors 51—51 that are assembled to the base. The carrier 61 is adapted to have the plurality of conductors 54—54 assembled thereto after which the carrier is assembled to the base 60 in a manner to cause the metallic contact elements 62—62 to interconnect the conductors 51—51 to corresponding ones of the conductors 54—54. Associated with the base 60 and the carrier 61 are strain relief strips 63 and 64 for the conductors 51—51 and 54—54, respectively. Further, the carrier 61 has a retaining strip 65 associated with it during steps of the connection process.

Viewing now FIGS. 1, 2, 3, and 4, it can be seen that the base 60 is an elongated bar-like member and is made of a dielectric material such as, for example, polycarbonate. The base 60 is formed with a top surface 67 and a bottom surface 68 which are interconnected by a side surface 71 and side surfaces 73 and 74 that are connected through a step 77.

The base 60 is adapted to receive and to retain the conductors 51—51 of the first cable. In order to do this, the base 60 is formed with a plurality of grooves 81—81 transversely across the elongated member between partitions 82—82. Each of the grooves 81—81 is adapted to hold at least one of the largest gauge size conductors that is to be spliced with the system 50. Typically, each of the grooves 81—81 has a width of about 0.046 inch and a depth of about 0.050 inch. The depth of each groove 81 is such that its depth exceeds the diameter-over-dielectric (DOD) of the largest gauge size conductor to be spliced with this system by about 0.005 to 0.010 inch. In a preferred embodiment, each of the conductors 51—51 of the first cable is positioned in one of the grooves 81—81 to cause the array of conductors to have a predetermined ordering. It should be observed that each of the grooves 81—81 has a vertical portion 83 that extends to the step 77.

Figure 5:
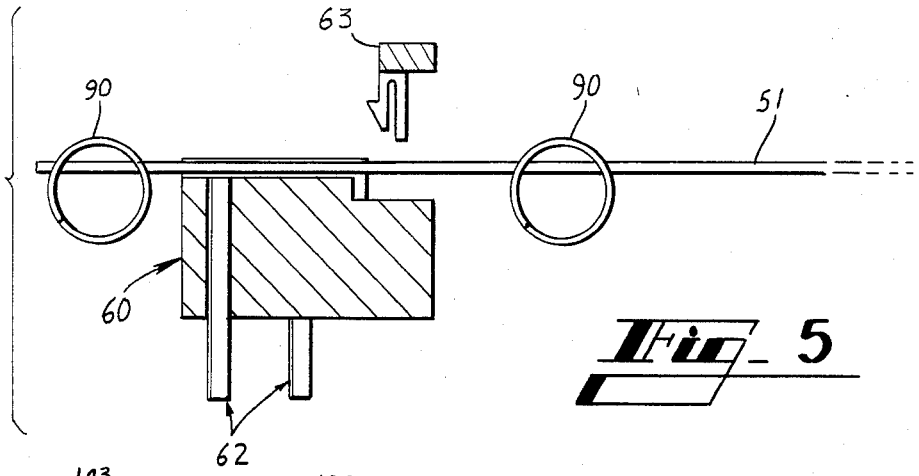
FIG. 5 is a cross-sectional end view of the base with conductors of the first cable being positioned in grooves and with a conductor strain relief strip positioned for assembly to the base.
Figure 6:
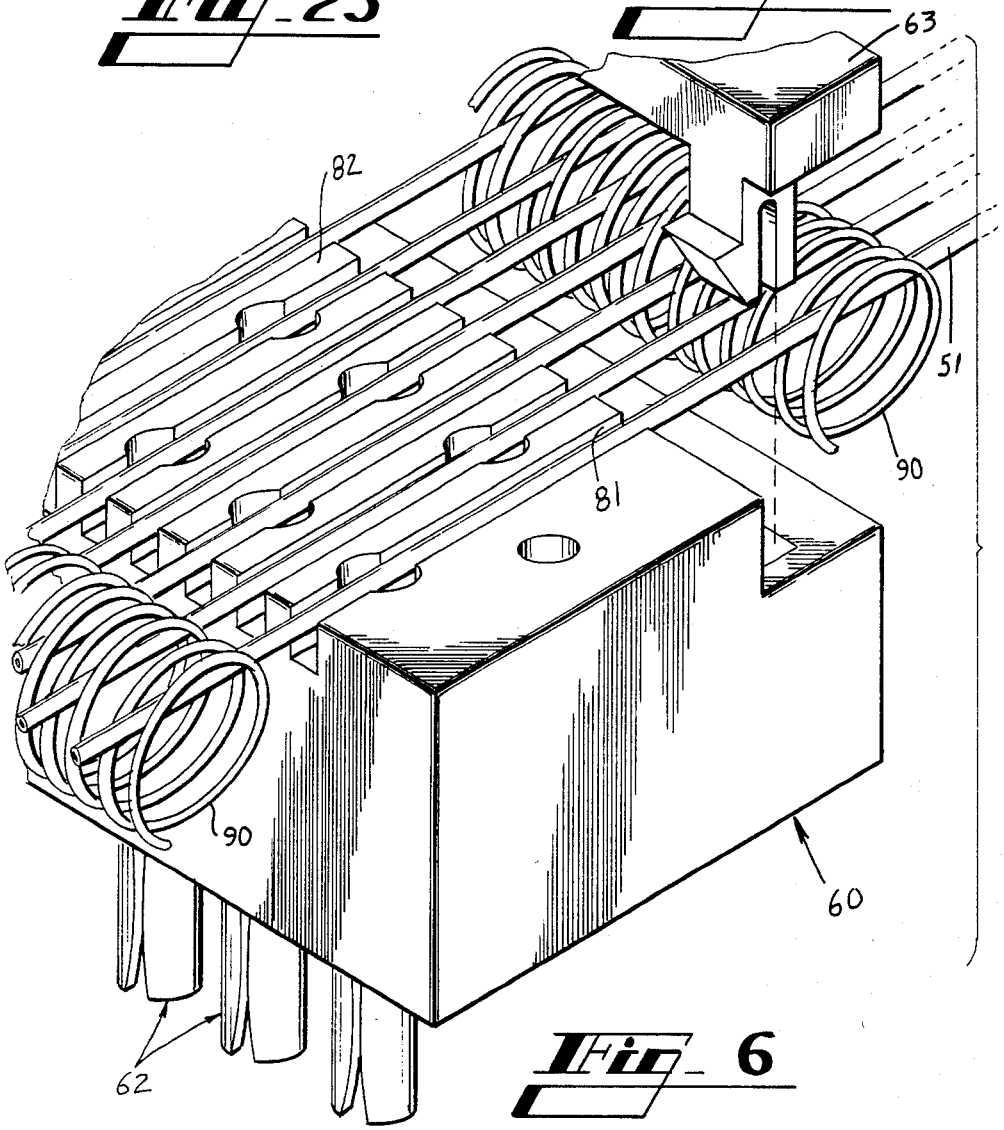
FIG. 6 is a perspective view of the base with conductors of the first cable being positioned in the grooves thereof.

Associated with the base 60 is the strain relief strip 63 which is adapted to be mounted on the step 77 with a plurality of bifurcated locking elements 87—87 that depend from it. One of the furcations includes a hooked end 88 which is adapted to snap-lock under a ledge 89 formed within a counterbored hole 91 in the base 60 between the step 77 and the bottom surface 68. After the conductors 51—51 have been placed in the grooves 81—81 with the assistance of combs 90—90 on each side of the base 60 (see FIGS. 5 and 6), the conductors are turned downwardly in the side grooves 83—83 and are secured in engagement with the step 77 by snap-locking the elements 87 within the holes 91—91 (see FIG. 7). This secures the conductors 51—51 against inadvertent movement during both the engagement of the contact elements 62—62 with the conductors 51—51 and during handling prior to the actual splicing.

Also associated with the base 60 is a cover 100 (see FIG. 7), which, in the preferred embodiment, is used temporarily during shipment and handling. The cover 100 is adapted to enclose the grooves 81—81 and spans between the surface 71 and an outer surface 101 of the strain relief strip 63. In the preferred embodiment, the cover 100 is made of a dielectric material. It has a plurality of slots 102—102 formed in a side surface 103 which are aligned with the grooves 81—81.

Not only is the base 60 formed with a plurality of grooves 81—81 but it also has provisions for mounting a plurality of the metallic contact elements which interconnect electrically the conductors of the two cables. This is accomplished by forming a plurality of contact-receiving apertures 110—110 (see FIGS. 1, 3, and 4) in the base 60 in two rows that extend transversely of the grooves 81—81. Also, the apertures 110—110 extend through the base 60 in the preferred embodiment and are normal to the grooves. Moreover, each of the apertures 110—110 is associated with and communicates with one of the grooves 81—81 with adjacent apertures being staggered as between the rows. It should also be noted that the apertures 110—110 may extend completely through the base 60 from the top surface 67 to the bottom surface 68, as in the preferred embodiment; however, in other instances they may be formed as blind holes which do not communicate with the bottom surface.

Figure 3:
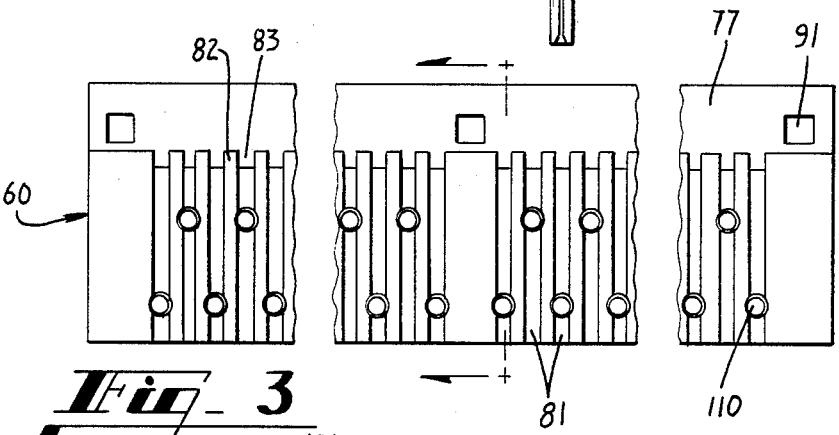
FIG. 3 is a plan view of the base of FIG. 2.
Figure 4:
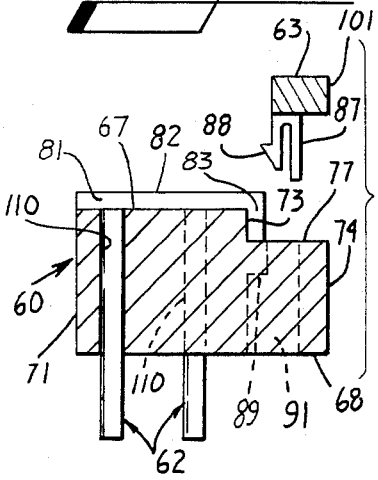
FIG. 4 is a cross-sectional end view of the base of FIG. 2.

Further as can be seen in the plan view of FIG. 3, the contact-element-receiving apertures 110—110 are formed in the base 60 and aligned with the grooves such that portions of the adjacent partitions 82—82 are also removed. The diameter of each of the apertures 110—110 is slightly less than the outside diameter of the contact element 62 which is to be received therein.

Each of these apertures 81—81 is adapted to receive a contact element 62 in the form of a tubular member. The contact element 62 is disclosed and claimed in Application Ser. No. 302,865 which was filed on Sept. 16, 1981 in the name of E. C. Hardesty and which issued on May 15, 1984 as U.S. Pat. No. 4,448,472. One of the contact elements 62—62 is positioned in selected ones or in each of the apertures 110—110.

Figure 10:
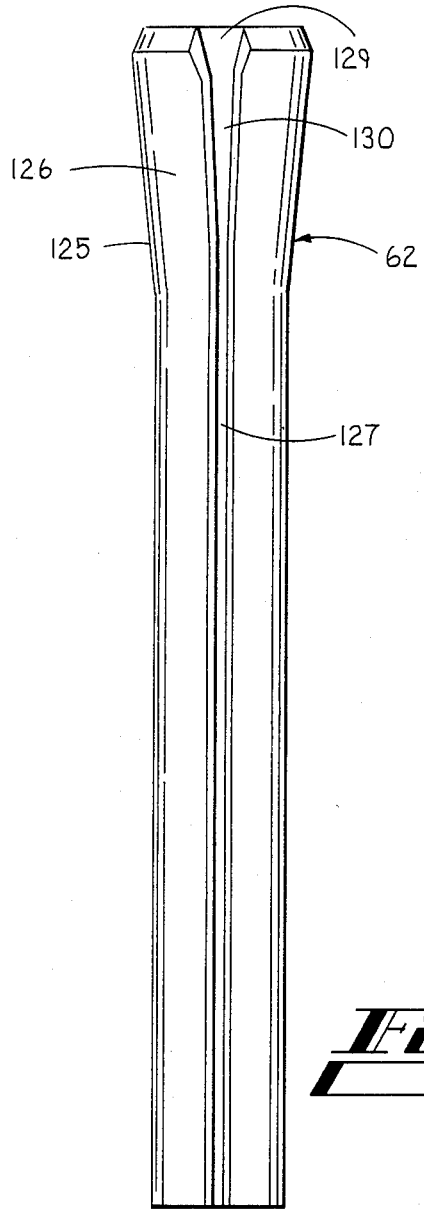
FIG. 10 is a side elevational view of the contact element which is mounted in the base.

Each contact element 62 includes an open-ended tubular member 126 (see FIGS. 8-10) which is made from a relatively hard material such as, for example, spring steel, Phosphor bronze, beryllium-copper, or hard brass. In a preferred embodiment, the tubular member 126 is formed to include a tapered or flared portion 125 (see FIGS. 8 and 10). Typically, the tubular member 126 has an outer diameter which tapers from about 0.072 to about 0.065 inch and a wall thickness of about 0.014 inch. The system of this invention may also include a contact element in which the tubular member 126 is cylindrical throughout its length (see FIG. 2).

Figure 11:
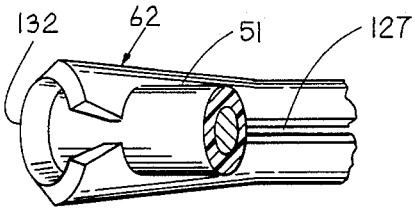
FIG. 11 is a perspective view of an insulated conductor received in a slot of the contact element.

In order to provide particular connection characteristics, the contact element 62 is designed to have a relatively high stiffness. This is provided by the tubular member 126 which has a relatively small inner diameter "$d_i$" (see FIGS. 10-12) and a relatively large wall thickness "t". The wall thickness is substantially less than the diameter of the conductive element 53 of an insulated conductor to be terminated by the contact element 62. Since its stiffness is also a function of modulus of elasticity as well as of its configuration, the tubular member 126 is made of material having a relatively high modulus.

Figure 13:
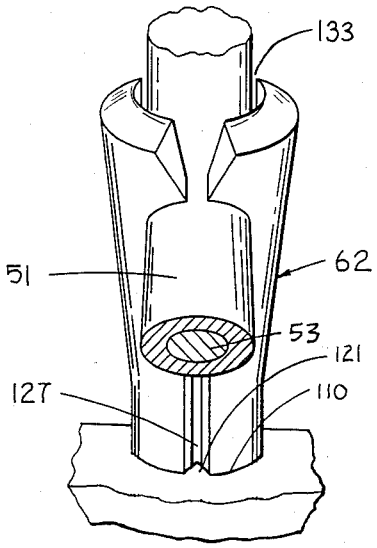
FIG. 13 is a perspective view of an alternative embodiment of the contact element of the system of this invention.

Also, the base 60 could be formed to provide a fin 121 (see FIG. 13) which protrudes into each aperture 110. As each contact element is inserted with its slot 127 aligned with the groove 81, the fin 121 enters the slot 127 and keeps it aligned with the groove. Further, the fin 121 is helpful in orienting each contact element for insertion into an aperture 110.

Figure 2:
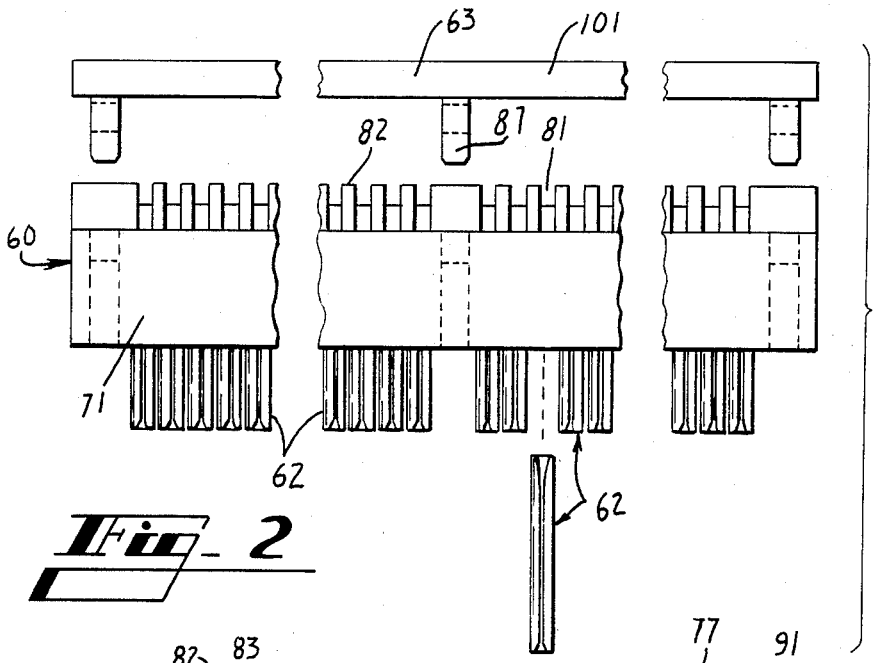
FIG. 2 is a front elevation view of a base of the connector system and of contact elements that are mounted in the base and a strain relief strip.

In order to receive and to retain insulated conductors, the tubular member 126 includes a longitudinally extending slot 127 (see FIGS. 8 and 10) which is parallel to a centerline 128 of the tubular member. The slot 127 is referred to as a conductor-receiving slot and in a preferred embodiment includes an entry portion 129 and a tapered portion 130 that communicates with an inner portion 131. The entry portion 129 is configured to facilitate the movement of an insulated conductor into the portion 130. As such, it is flared with a relatively wide mouth that transitions into the tapered portion 130. The above-described slot configuration is also used with the completely cylindrical contact element which is shown in FIG. 2.

The slot portions 130 and 131 generally have a width which is less than the diameter, Dw (see FIG. 12), of the conductive element 53 of the insulated conductor 51. In one embodiment, the entry portion 129 has a width of 0.042 inch at its outer end and about 0.020 inch at its inner end and a length of about 0.025 inch. From the 0.020 inch, width, the tapered portion 130 which has a length of about 0.100 inch decreases to 0.010 inch at its junction with the inner portion 131. Typically, the contact element 62 of this invention which has a length of about 0.63 inch is destined to terminate 22 to 26 gauge insulated conductors which have conductive element diameters of 0.025 and 0.016 inch, and diameter-over-dielectric (DOD) diameters of 0.045 and 0.029 inch, respectively.

Figure 8:
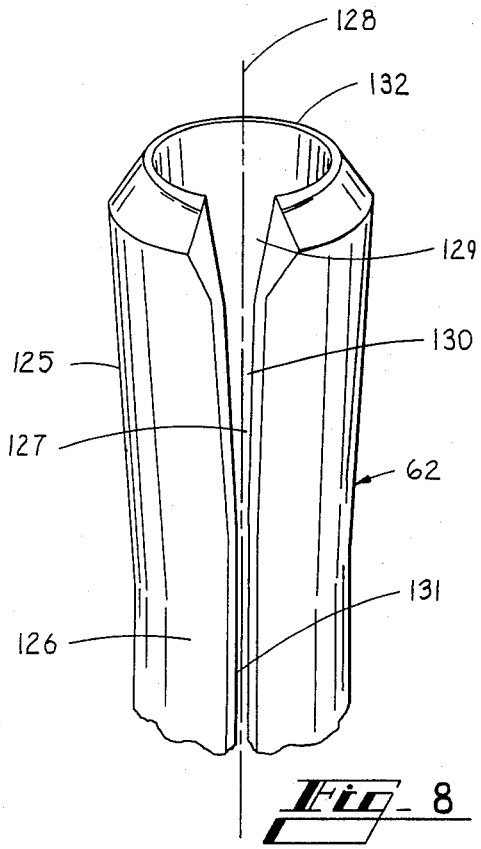
FIG. 8 is a perspective view of a contact element of the system of this invention.
Figure 9:
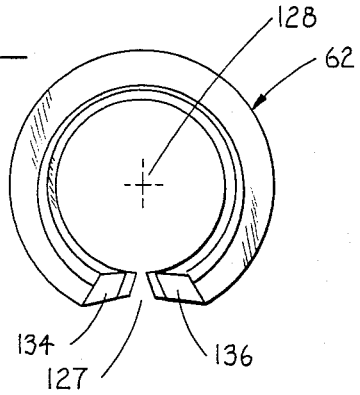
FIG. 9 is an enlarged end view of the contact element of FIG. 8.
Figure 14:
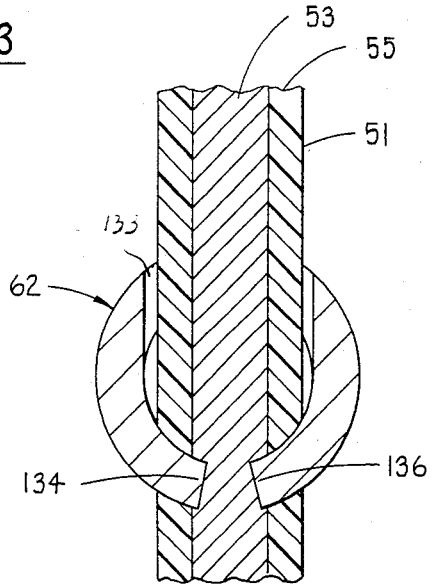
FIG. 14 is an end view in section of the alternative embodiment of FIG. 13.

A portion of the tubular member 126 which is opposite to the entrance 129 is beveled (see FIG. 8). In a preferred embodiment, the beveled portion is coined or otherwise formed to provide a thin or relatively sharp edge 132 at a portion of the periphery opposite to the slot 127. When a conductor 51 or 54 is moved into the slot 127 of the contact element 62, it is severed by the coined portion 132 (see FIGS. 11–12). There may be instances where conductor cutoff is not desired. For those applications, the tubular member 126 is formed with an opening 133 in the rear wall opposite to the slot 127 (see FIGS. 13–14).

Figure 15:
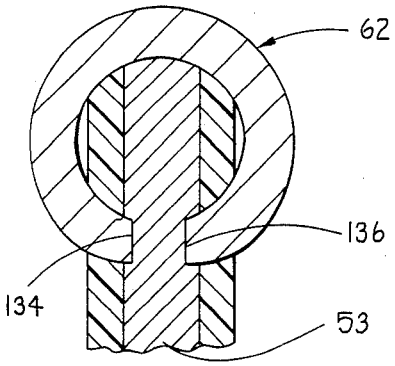
FIG. 15 is an end view of an alternative embodiment of the surfaces which form the conductor-receiving slot of the contact element of the system of this invention.

Walls or surfaces 134 and 136 (see FIG. 9) which define the slot 127 are formed in a particular manner which enhances the electrical engagement with the insulated conductors 51—51. In a preferred embodiment, the slot 127 is formed so that the walls 134 and 136 generally diverge such as radially, for example, from the centerline 128 of the tubular member 126 (see FIGS. 8–9 and 12). In an alternative embodiment shown in FIG. 15, the walls which define the slot 127 are parallel.

When a conductive element 53 is moved into the slot 127 of the contact element 62, the stiffness of the tubular member 126 prevents any deflection of the surfaces 134 and 136 except that which is substantially negligible. As an insulated conductor 51 is moved into the slot 127, edges 137 and 138 as well as the edges 141 and 142 of the walls 134 and 136, respectively, experience substantially negligible deflection and slice through the insulation 55 and become embedded in the conductive element 53 of the conductor 51. Any weakening of the conductive element 53 is offset by suitable strain relief provisions. The electrical engagement is caused to occur as a result of the slot walls 134 and 136 nicking the conductive element. This is unlike some prior art connection systems in which the conductors are deformed, other than by nicking, and reconfigured as they are moved into the slot and are connected electrically to the slot walls by a compressive engagement therewith.

Figure 12:
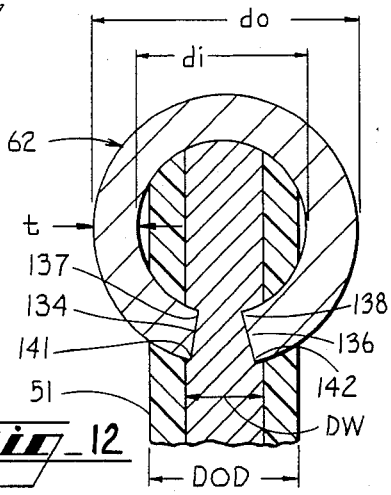
FIG. 12 is an end view in section of the contact element of FIG. 8 with an insulated conductor received in a portion of its slot.

Nicking of the conductive element 53 of the conductor 51 or 54 is assured in the embodiment shown in FIG. 12. However, where the walls 134 and 136 are parallel, the contact element 62 may require further definition to achieve a nicked engagement rather than the prior art compressive engagement of the conductive element 53. This is accomplished with a contact element 62 in which the thickness of the tubular member 126 is substantially less than the diameter, Dw, of a wire-like conductive element which is moved into the slot 127.

These important connection characteristics of substantially negligible deflection and nicking are achieved while maintaining a relatively small size of the tubular member 126. Not only is the thickness "t" of the tubular member 126 less than the diameter Dw of the conductive element 53, but also the DOD of the insulated conductor 51 or 54 of the expected range is between 0.045 and 0.029 inch. The $d_i$ (see FIG. 12) of the tubular member varies from about 0.044 to 0.037 inch. This results in an extremely high density of the contact elements 62—62 per unit area.

In the use of the contact element 62 in the preferred splicing system 50 of this invention, it may become necessary for more than one conductor 51 to be received in the slot 127. One of the desired features of a contact element is that it is capable of being used to interconnect conductors of different gauge size as well as pairs of conductors of the same gauge which fall in a predetermined range. As will be recalled, this presents a problem in prior art bifurcated beam contact elements having relatively resilient furcations which are deflected by a first inserted conductor and then further deflected as the first inserted conductor is moved further into the slot by a second conductor.

The problem of terminating more than one conductive element in the same slot 127 is overcome with the contact element 62 having dimensions and being made of a material so that the walls 134 and 136 which define the slot 127 are substantially unyielding. The stiffness of the contact element 62 is such that when a conductor or conductors are moved into the slot 127, the deflection of the surfaces that define the slot is substantially negligible. As a result, the contact element 62 of this invention has a substantially stable slot configuration.

In the contact element 62 of this invention, this capability is also provided by forming the slot 127 so that the portions of its walls which engage the conductors are spaced apart to nick the conductive element of each conductor. The conductor-receiving slot 127 is sized so that the walls 134 and 136 which define the slot displace material from each side of each conductor 51 or 54 that is moved into the slot. It is not uncommon for the conductive element of the conductor 21 to be nicked about 10 to 15% of its diameter on each side for a total displacement of about 25%. This amount of nicking guarantees a gas-tight connection. The spacing is such that there is sufficient nicking of the smallest expected conductor to establish a suitable electrical connection and such that the nicking of the largest expected conductor will not unduly weaken its cross-section.

The amount of nicking must be controlled not only as to its minimum value but also as to its maximum. While a minimum amount of nicking is required in order to establish sufficient electrical engagement of the conductors, there is also a maximum amount which must not be exceeded. If the maximum value was exceeded, the strength of the conductor may be unduly impaired which could lead to deconnection at some future time. Control of the amount of nicking is much easier when the walls which define the conductive element receiving slot are substantially non-deflecting as here.

This problem is overcome in one embodiment of the invention in which the edges 137 and 138 in the embodiment shown in FIG. 12 are spaced apart a distance which does not provide excessive nicking. As can be seen in FIG. 12, with the walls 134 and 136 which define the slot 127 being directed in a radial direction, their edges 133 and 134 nick the conductor at diametrically opposed locations. The nicking in such an arrangement is cumulative and if not controlled could impair the mechanical strength of the conductor. Of course, in an embodiment shown in FIG. 15, the distance between the parallel walls which define the slot 127 must be spaced a sufficient distance apart to prevent excessive nicking.

Figure 16:
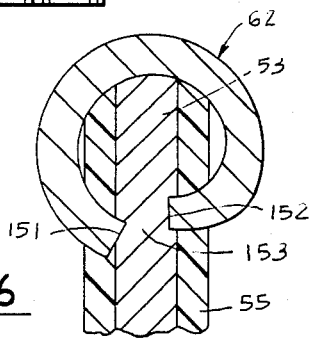
FIG. 16 is an end view in section of another alternative embodiment of the contact element of this invention with an insulated conductor received in a portion of its slot.

The problem of cumulative nicking may be avoided by insuring that the nicking of the conductor does not occur at diametrically opposed locations. This is accomplished by the contact element 150 which is shown in FIG. 16. One of the walls 151 or 152 which define a slot 153 is turned slightly so that its associated edge which engages the conductor 51 or 54 does so at a location other than one diametrically opposed to the other edge.

Going now to FIGS. 1, and 17-19, there is shown the carrier 61 to which are assembled conductors 54—54 of the second cable. The carrier 61 is adapted to be assembled to the base 60 to cause the conductors 54—54 to be connected electrically to the conductors 51—51 of the first cable.

The carrier 61 is made of a dielectric material and as is seen comprises an elongated body member and includes side surfaces 171 and 172 which extend from a surface 173 toward an opposite surface 174. For receiving conductors 54—54, the carrier also includes a plurality of grooves 181—181 formed transversely across the surface 173 thereof between partitions 183—183. These grooves have the same width and generally the same depth as those which are formed in the base 60. Further, the grooves 181—181 in the carrier 61 are formed so as to have the same center-to-center spacing as the grooves in the base. The one side surface 171 also includes a plurality of grooves 188 which are aligned with the grooves in the surface 173. The other side surface 172 is stepped and includes an indented surface 189 which ends in a ledge 191.

Figure 19:
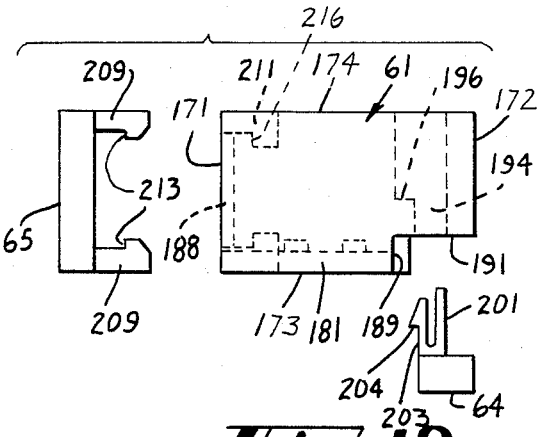
FIG. 19 is an end view of the carrier and its associated retainer and strain relief strips.

As can best be seen in FIG. 19, the ledge 191 is adapted to receive the strain relief strip 64 for the carrier 61. Formed at spaced locations along the ledge 191 are cavities 194—194 each of which is formed internally with an undercut 196 and which communicates with the ledge 191 and with the surface 174. The strain relief strip 64 is similar if not identical to that for the base 60 and includes depending bifurcated locking tabs 201—201. One furcation 203 of each of the tabs includes a hook-like end 204 to latch under the undercut 196 within the cavity 194 as the strip 64 is moved toward the ledge.

Figure 20:
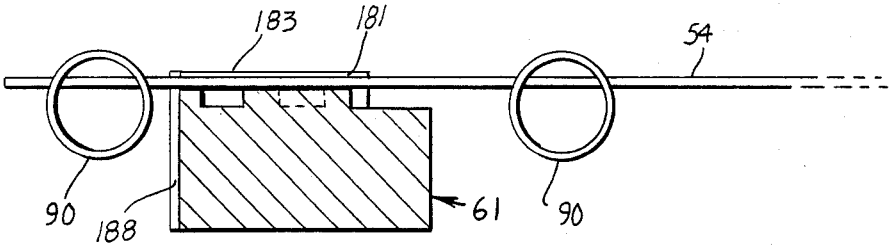
FIG. 20 is an end view in section to show conductors of the second cable being positioned in grooves of the carrier.
Figure 21:
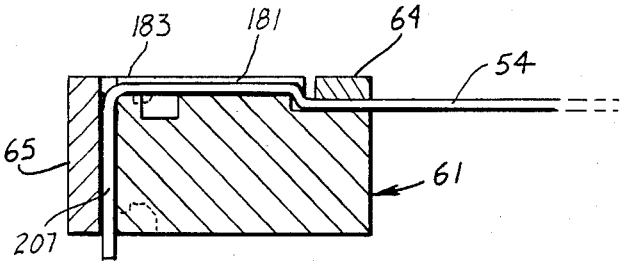
FIG. 21 is an end view in section of the carrier with conductors of the second cable in the grooves and with its retainer and strain relief strips assembled thereto.

Each of the conductors 54—54 is positioned in a predetermined one of the grooves 181—181 in the carrier 61 (see FIG. 20) with an end portion 207 of each conductor extending downward through an aligned groove 188 in the side surface 71 (see FIG. 21). The retaining strip 65 having hooked ends 209—209 extending therefrom is capable of being assembled to the carrier 61 at the side 171 to cover the grooves 188—188. The ends 209—209 are adapted to be received in openings 211—211 which communicate with the sides 173 and 174 of the carrier. The ends 209—209 are dimensioned so that after the retaining strip 65 has been moved into engagement with the conductor end portions 207—207 that extend downwardly along the side surface 171 and forces applied thereto to compress slightly the insulation, edges 213—213 of the end portions snap-lock behind internal surfaces 216—216 of the openings 211—211 to hold the retaining strip to the carrier 61. It should be appreciated that this retaining strip 65 is only a temporary expedient to assist in holding the conductors 54—54 of the second cable to the carrier 61 until the carrier has been mated with the base 60. On the other hand, the strain relief strip 64 as well as the strip 63 becomes a permanent part of the system for each connection life.

It should also be noted that the connector system of this invention is a universal system for any gauge size conductors which are contemplated. As will be recalled, the DOD of this range of conductors is from 0.045 to about 0.029 inch. The tab of the retaining strip 65 and of the strain relief strips 64 and 64 of both the carrier 61 and the base 60 and the cavities in which they are received are such that a craftsperson is able to compress the insulation covers sufficiently to cause the tabs to snap-lock under their respective ledges.

Figure 23:
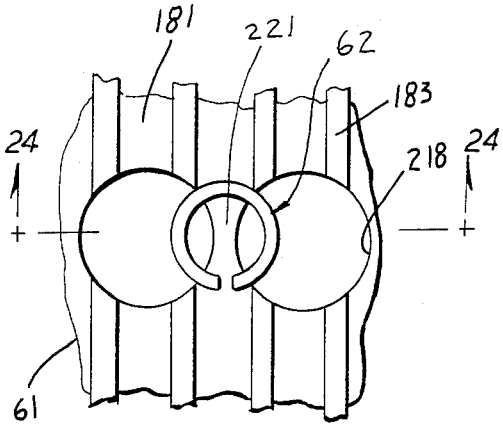
FIG. 23 is an enlarged plan view of a portion of the carrier to show the relative positions of the contact element and the grooves and formed bridges of the carrier.
Figure 24:
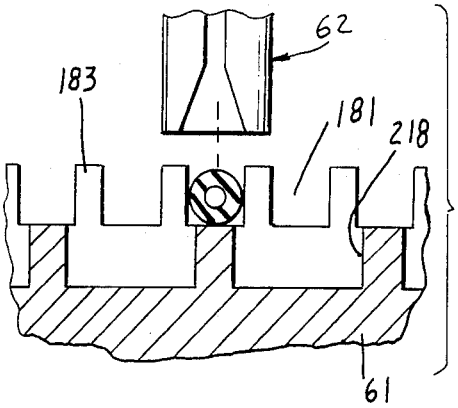
FIG. 24 is an elevational view in section of a portion of the carrier shown in FIG. 23 and taken along lines 24—24 thereof.
Figure 17:
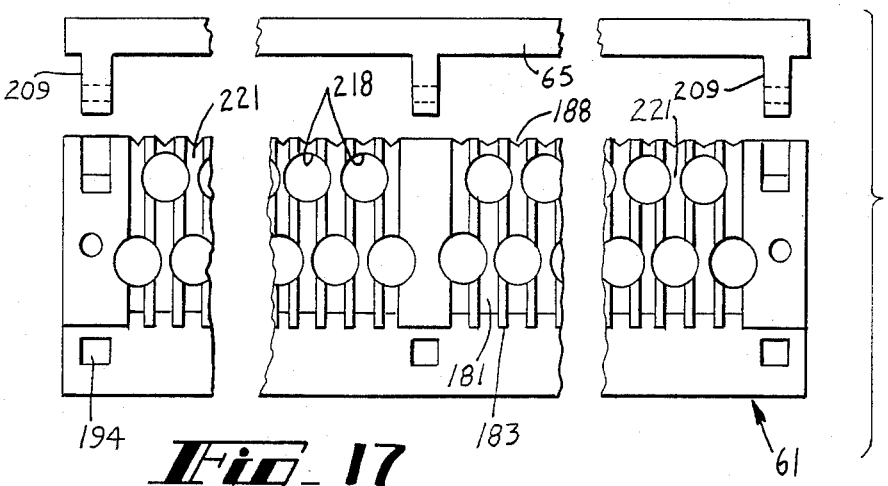
FIG. 17 is a plan view of a carrier of the connector system of this invention.
Figure 18:
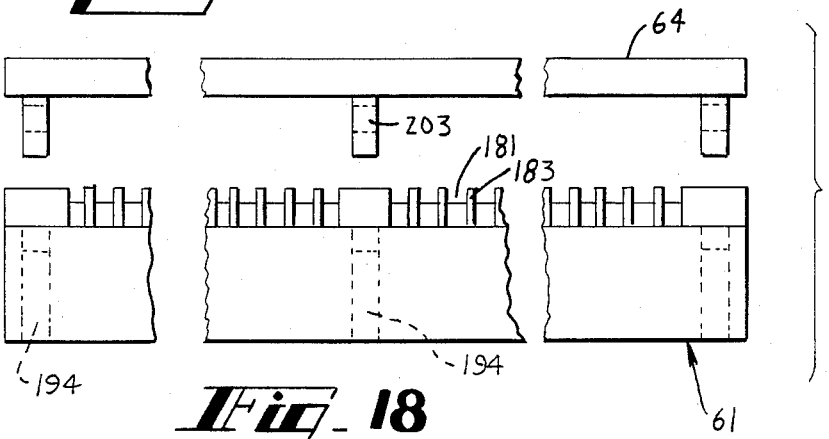
FIG. 18 is a front elevational view of the carrier.
Figure 22:
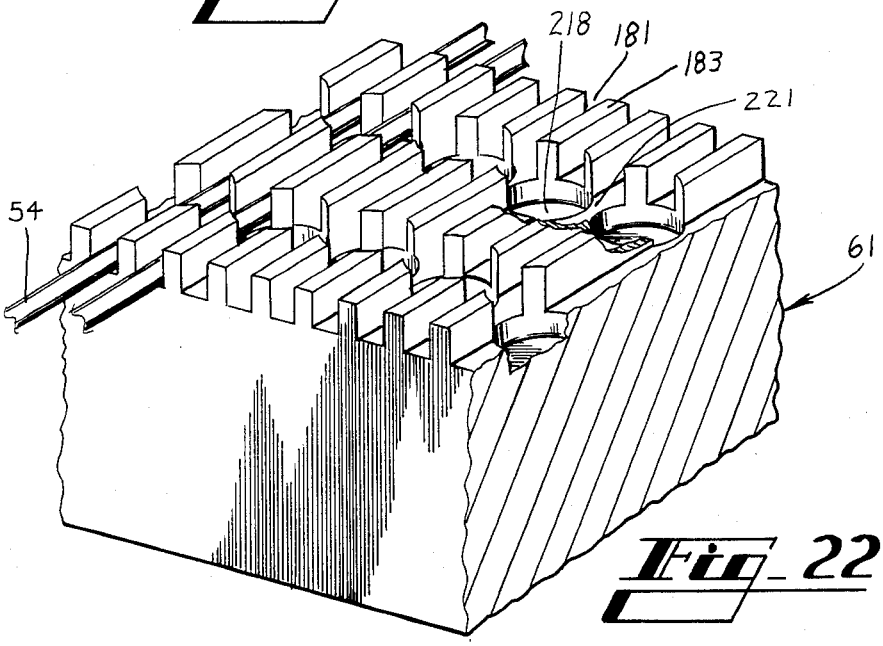
FIG. 22 is a perspective view of a portion of the carrier to show the conductors of the second cable positioned in the grooves and over bridges which are formed along the grooves.

Referring now to FIGS. 17 and 18, it will be seen that the top surface of the carrier 61 is not only formed with a plurality of grooves 181—181 between parallel spaced partitions 183—183, but also with two rows of openings such as circular holes 218—218. The holes are formed into the carrier 61 with their centers aligned with the longitudinal centerline between the two being midway between adjacent partitions with portions of two holes being spaced along each partition. Further, the diameter of each hole is greater than the width of a groove 181 but less than the sum of twice the width of a partition and twice the width of a groove. As a result and as can be seen in FIGS. 22-24, adjacent points of adjacent holes in the same row are separated by a distance which is less than the width of a groove. The holes cause the formation of a bridge 221 along each groove 181 with portions of the adjacent partitions 183—183 having been removed. It should also be realized that the openings need not be circular holes but could be semi-circular with the curved portions being adjacent to each other to form the bridge 221, or rectangular.

This arrangement is a practical embodiment of a process called trepanning in which an annular portion of a surface is removed. If an insulated conductor were positioned across the annular cut-out and a contact element 62 inserted thereinto, the end portion of the conductor would be severed and the conductor would be caused to be moved into the conductor-receiving slot of the contact element 62. Trepanning is useful in that the forces which must be applied to the contact element 62 to insert it in the cut out and to establish electrical contact with the conductor are substantially less than those required to drive the element into an unprepared surface.

The arrangement in FIGS. 22-24 accomplishes the same or substantially the same result and surprisingly has some advantages over a trepanned hole. By forming the bridge 221 and removing the material of the partitions, substantially less forces are required to drive the contact elements 62—62 into the carrier 61 and into conductive arrangement with the conductors 54—54 than without the holes. One portion of the bridge 221 is aligned with the conductor-receiving slot of the contact element and is effective to cause the conductor 54 in the groove 181 to be moved into the conductor-receiving slot of the contact element. Also, advantageously, the opposite end of the bridge 221 is effective as an anvil against which the end portions of the conductors are severed by the coined peripheral edges of the contact elements.

Figure 7:
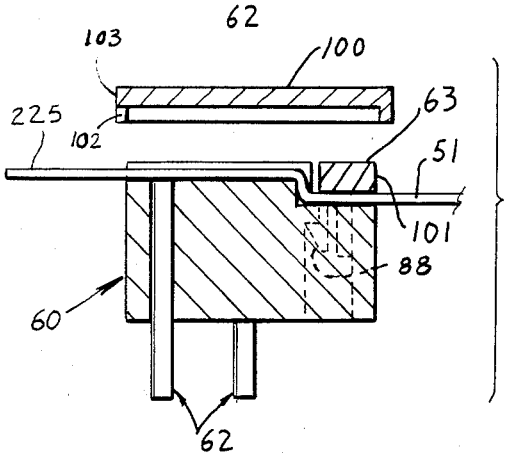
FIG. 7 is a cross-sectional end view of the base with the conductors of the first cable in the grooves, with the strain relief strip assembled to the base and with a cover about to be assembled thereto.

In the preferred embodiment, the base 60 having the apertures 81—81 formed therein is pre-loaded with contact elements 62—62, one in each aperture, such that one end of each is generally flush with the bottom of its groove 81 and with the other end depending from the underside 68 of the base (see FIG. 7). Importantly, a conductor-receiving slot 127 of each contact element is aligned with its associated groove 81. As such, the base 60 is conditioned to receive the conductors 51—51 of the first cable after which the strain relief strip 63 and the cover 100, in that order, are assembled to the base.

Figure 25:
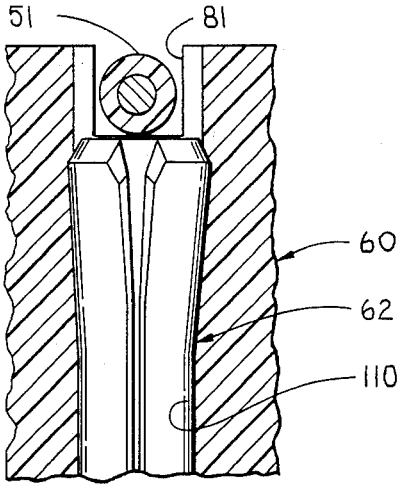
FIG. 25 is an elevational view of the contact element of the inventive system positioned in an aperture of the base with a conductor of the first cable positioned in a groove with which the aperture communicates.

In using the connector system 50, a craftsperson positions the conductors 51—51 of the first cable 52 in the grooves 81 of the base 60 and places the cover 100 over the base 60. After a conductor 51 has been positioned in each groove 81 of the base 60 such that an end portion 225 extends beyond the base and the base fitted with its strain relief strip 63 and cover 100 (see FIGS. 7 and 25), steps are taken to establish an electrical connection between the contact elements 62—62 and the conductors. This is accomplished by causing relative motion between the contact elements 62—62 and the cover 100. For example, the contact elements 62—62 are moved within their apertures 110—110 through a first incremental distance toward the cover 100. Inasmuch as the conductor-receiving slots 127—127 of the contact elements 62—62 and the grooves 81—81 are aligned, the conductors 51—51 are caused to be moved into the entry portions of the slots of the contact elements. Continued motion of the contact elements moves the beveled or coined end of each contact element into penetrating engagement with the cover (see FIGS. 26 and 27). This increment of movement of the contact elements 62—62 also causes the conductor 51 which was initially positioned in the groove 81 to be moved from the entry of each slot further inwardly toward the position shown in FIG. 26.

Figure 26:
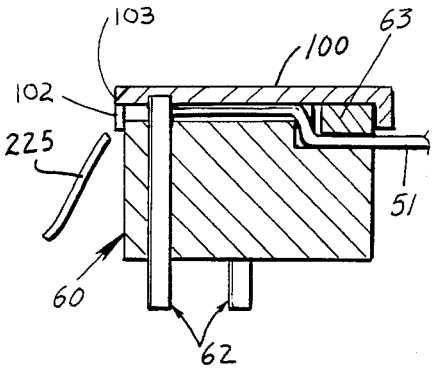
FIG. 26 is an end view in section of the base after the conductors of the first cable have been severed.
Figure 27:
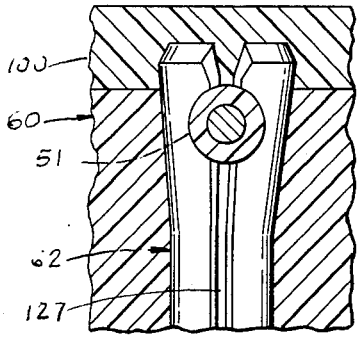
FIG. 27 is an elevational view of the contact element of FIG. 25 after having been moved to have its end embedded in the cover and to have a conductor in a groove of the base moved into its slot.

These steps not only establish electrical contact between the contact elements 62—62 and the conductors 51—51 but also through the embedment of the coined ends in the cover 100 causes the cover to be held to the contact elements and hence to the base 60 (see FIG. 26). Also, as the contact elements 62—62 are driven into the cover 100, the end 225 of each conductor 51 which extends beyond the coined edge 132 and out of the groove 81 is severed (see FIG. 26). Following the step of moving the contact element, a craftsperson need only pull the severed ends of the conductors from the grooves of the base 60.

This feature not only provides for an automatic cutoff of the excess lengths of the conductors but also has an advantageous impact on size of the system. A comparison of split beam contact elements such as the one shown in prior art systems and the contact element 62 of this invention shows that the outside diameter of the latter is substantially less than the so called waist width of the split beam type. As a result, the use of the contact elements of this invention results in a reduction of the length of the base 60. As will be recalled, one prior art connector realizes some economies of space by staggering the split beam connectors in rows, but the contact element of this invention is an advance over that. Moreover, the contact element 62 of this invention is itself the means for severing the excess length of the conductor. This provides obvious advantages over a system which requires a separate tool for severing or a plurality of blades which are incorporated into the connector but which are separate and apart from the contact element.

Next, the second group of conductors 54—54 are assembled to the carrier 61 and are held in engagement therewith by the retaining strip 65 and by the strain relief strip 64 (see FIGS. 20 and 21). The conductors 54—54 of the second cable 56 are routed along the grooves 181—181 in the top surface of the carrier 61 with an end portion 207 of each conductor extending downward through an aligned groove 188 in the side surface 171 (see FIG. 21). The retaining strip 65 is assembled to the carrier 61 to cover the side grooves and to retain the end portions of the conductors 54—54. The strain relief strip 64 is moved into place toward the ledge 191 (see FIG. 21). After the strip 64 has been moved to engage its conductors 54—54 and cause them to assume an S-shaped configuration through the vertical grooves and the ledge, and after some degree of force has been applied to the strip to compress somewhat the insulation, the one furcation 203 of each locking tab 201 is caused to snap-lock beneath the undercut 196 of each associated cavity 194. This assembly as well as that of the conductors 51—51 to the base 60 may be accomplished within a factory environment.

Figure 31:
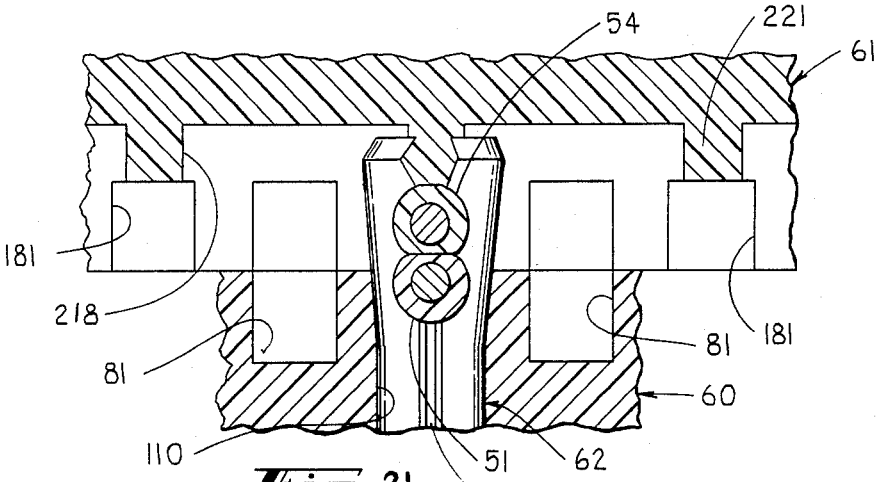
FIG. 31 is an elevational view of the contact element of FIG. 27 after it has been further moved to cause a conductor of the second cable held in a carrier to be moved in the conductor-receiving slot adjacent to the first conductor.
Figure 28:
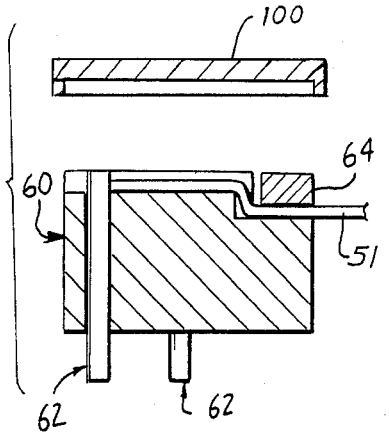
FIG. 28 is an end sectional view of the base with its cover removed therefrom after the conductors of the first cable have been terminated and just prior to assembly with the carrier.
Figure 29:
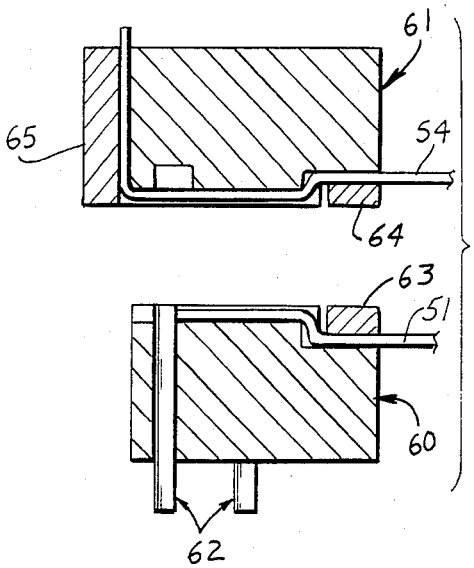
FIG. 29 is an end sectional view of the base with conductors of the first cable connected to the contact elements in the base and the carrier with the conductors of the second cable secured thereto positioned for assembly to the base.
Figure 30:
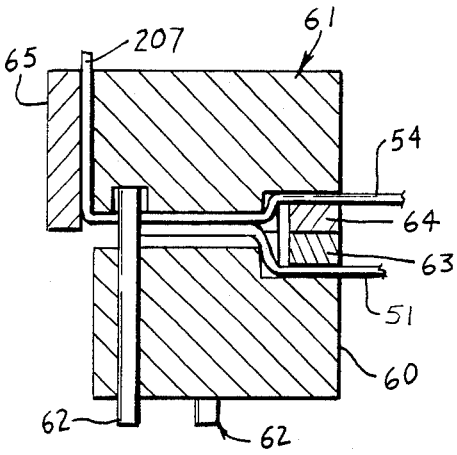
FIG. 30 is an end sectional view of the base and the carrier after they have been secured together and after the contact elements have been moved into the carrier to sever the end portions of the conductors of the second cable and to establish an electrical connection between the conductors of the two cables.

In the field, a craftsperson who wishes to splice the two cables 52 and 56 by connecting the conductors 51—51 of the first cable to the conductors 54—54 of the second cable removes the cover 100 (see FIG. 28), inverts the carrier 61 (see FIG. 29), and causes it to be secured to the base 60 such as by screws, bolts or other well-known expedients. As a result, the grooves 181—181 of the carrier 61 are aligned with the grooves 81—81 of the base 60 to align the conductors 51—51 and 54—54. Then the craftsperson causes the contact elements 62—62 or selected ones thereof to be moved toward the grooves 181—181 of the carrier 61 and the conductors 54—54 of the second cable which are positioned therein. The movement of the contact elements 62—62 to the positions shown in FIGS. 30 and 31 cause their beveled ends to sever the excess lengths of the conductors 54—54. Also, each bridge 221 (see FIGS. 22-24) which is formed along the grooves 181—181 causes the second conductor 54 which spans thereacross to be moved into the conductor-receiving slot 127 of the contact element 62 which is moved over that bridge. As will be recalled, each of the bridges 221—221 acts as anvil for conductor cutoff and as a stuffer to assist in movement of the conductor 54 into the slot 127.

Another advantage of the contact element 62 insofar as multi-conductor termination is concerned is realized by forming the slot 127 so that it tapers inwardly (see FIGS. 8 and 10) from the open end of the tubular member 126. When a first conductor 51 is moved further into the slot 127 by the introduction of a second conductor 54 (see FIGS. 30 and 31), the first conductor undergoes a slight increase in the amount of nicking instead of causing the walls to yield. Consequently, the second conductor which is introduced into the slot merely replaces the first in its initial position and is caused to have the desired minimum amount of nicking. As for the first, its movement farther into the slot 127 improves and guarantees the gas-tight connection between it and the walls 134 and 136. Unlike some prior art contact elements, the contact element 62 of this invention maintains suitable electrical engagement with a conductive element of an insulated conductor notwithstanding exposure to severe temperature cycling.

Figure 32:
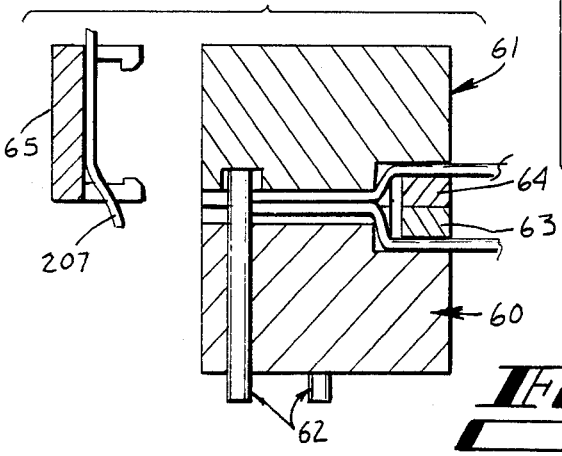
FIG. 32 is an end sectional view of the assembled base and carrier with the retainer strip and severed end portions of the conductors of the second cable removed.

To complete the assembly, the craftsperson then removes the retaining strip 65 from the carrier 61 (see FIG. 32). Since the retaining strip 65 was used to hold the conductors 54—54 prior to the connection to the conductors 51—51, it can now be removed. When this is done, the severed end portions 207—207 of the conductors 54—54 are separated from the carrier 61.

As can best be seen in FIG. 32, the completed splice system 50 includes the base 60 and the carrier 61 assembled thereto with the conductors 51—51 and 54—54 of the first and the second cables, respectively, therebetween. The conductors 51—51 and 54—54 are received in the slots of the contact elements 62—62 and are provided with strain relief by the strips 63 and 64.

Figure 33:
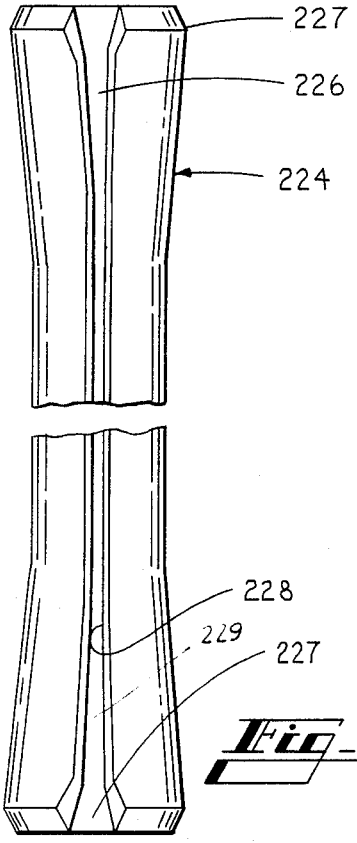
FIG. 33 is a side elevational view of another alternative embodiment of a contact element of the system of this invention in which bilaterial entries are provided.

It should be apparent that the system 50 of this invention could also include a branched connection. While the contact element 62 thus far has been described in terms of unilateral entry into a conductor-retention slot, the invention is not so limited. Depending on the total arrangement in which the contact element 62 is used such as in a branched connection, it may become important to the system to provide the capability of bilateral entry. For those situations, a tubular member 224 is provided with a conductor-receiving slot 226 having an entry portion 227 at each end of the tubular member (see FIG. 33). Because of the substantially rigid character of the tubular member 224, the walls of the slot are substantially stationary as conductors 51—51 are moved into either or both ends. As can be seen in FIG. 33, a portion 228 of the slot 226 is generally non-tapered and is connected to each entry portion 227 through a tapered portion 229.

Figure 35:
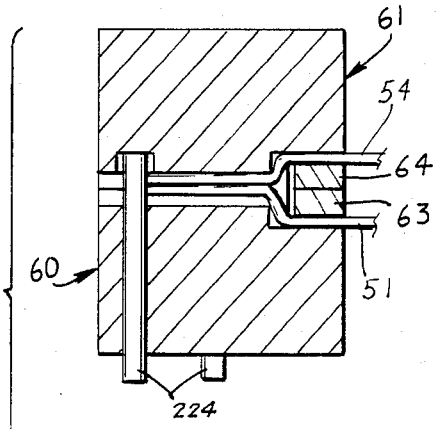
FIG. 35 is an end view in section of a connected base and carrier similar to that of FIG. 34 and showing another carrier positioned for assembly to an underside of the base.
Figure 35:
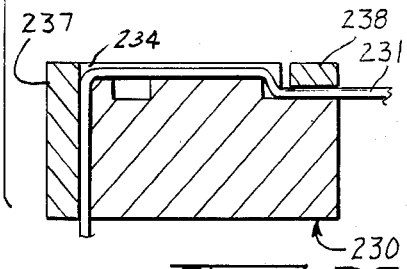
Figure 34:
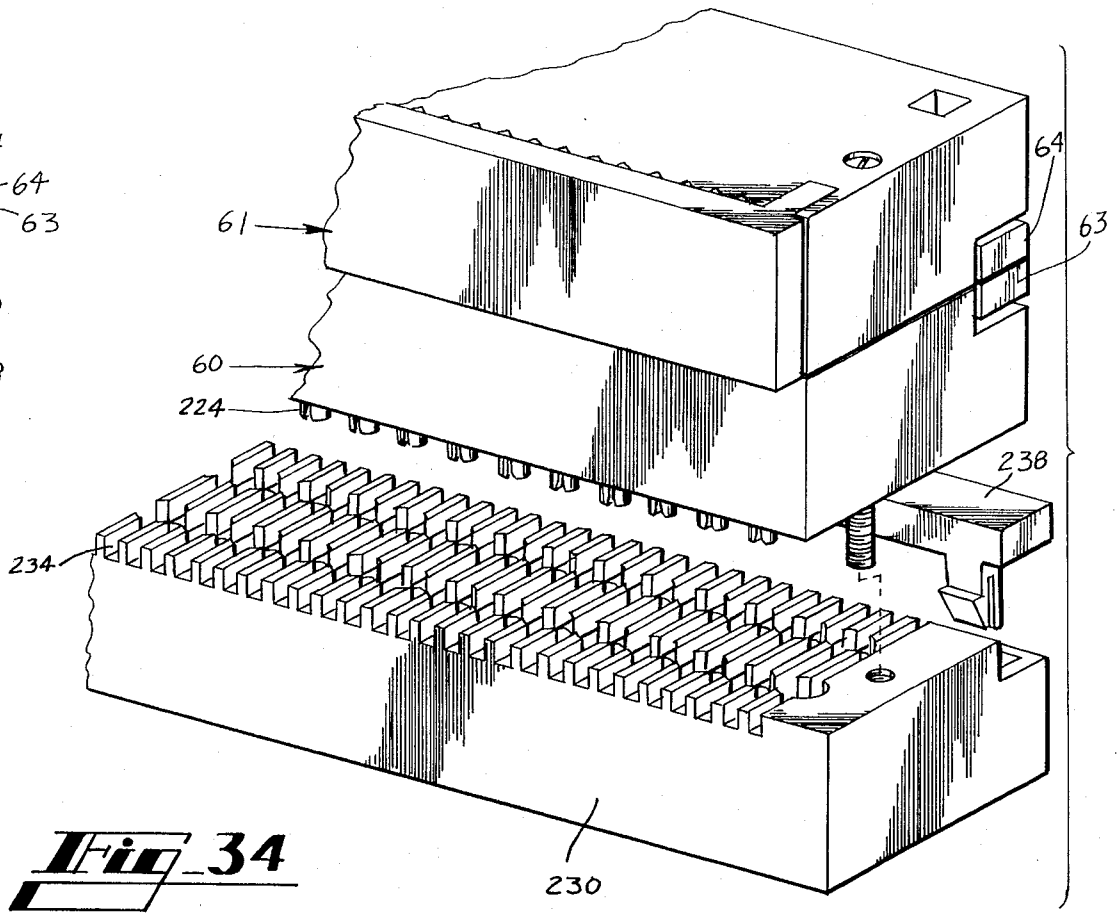
FIG. 34 is a perspective view of a connector system of this invention which includes the base and two carriers to establish a branched connection.
Figure 36:
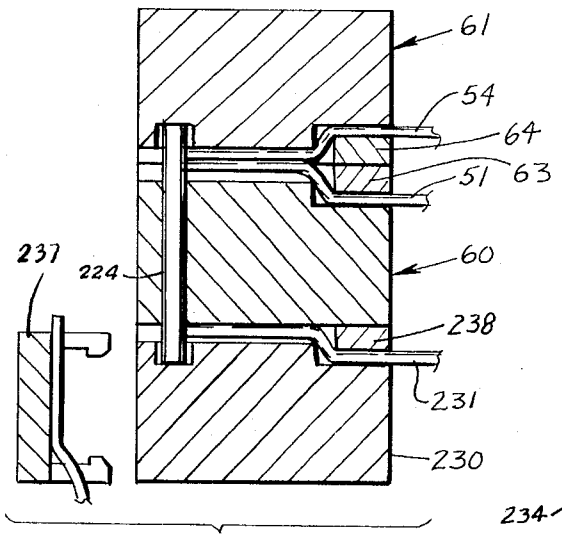
FIG. 36 is an end view in section of the connector system including a branched carrier assembled to the base.

Viewing now FIGS. 34–36, it is seen that another carrier strip 230 which is substantially identical to the carrier 61 having conductors 231—231 of a third cable positioned in grooves 234—234 thereof is assembled to the bottom side 68 of the base 60. Portions of the contact elements 224—224 protrude beyond the bottom side 68 of the base 60 and during assembly of the base and the second carrier strip 230, the conductors 231—231 of the third group are caused to enter the conductor-receiving slots 226—226 of those protruding portions. As before, the contact elements 224—224 sever the extending portions of the third group of conductors. After the assembly, a retainer strip 237 which is associated with the second carrier 230 may be removed while a strain relief strip 238 remains in place.

Modifications of the preferred embodiment may be made and are within the scope of the invention. For example, it is unnecessary for the contact elements 62—62 to extend beyond the bottom side of the base 60. The contact element receiving apertures 110—110 could just as well be blind holes with the contact elements 62—62 protruding into the grooves of the base. The cover 100 may be formed with parallel spaced ribs which are aligned with the grooves and which are effective to move the conductors into the conductor-receiving slots of the contact elements.

In another embodiment, the grooves 81—81 in the base 60 could be deepened to hold a conductor 51 of a first group and a conductor 54 of a second group. The contact elements 62—62 which are positioned within apertures that extend through the base are moved relative to the base 60 and cover 100 to cause both conductors in each slot to be moved into the conductor-receiving slot 127 of the contact element.

In those embodiments wherein the cover 100 remains after an electrical connection is established between conductors, the cover is made of a dielectric material such as polycarbonate. For the preferred embodiment, the cover could be made of other materials.

While the system of this invention is contemplated as being used to factory connectorize cables for field splicing, its use is not so restricted. For example, the ends of conductors to be spliced could be arranged in the factory for connecting in the field and held in the ordered array by adhesively backed tape. The connection to the base 60 and carrier strips may be done in the field with the task being simplified by the prior ordering in the factory environment.

The system of this invention also can be used in the field to splice corresponding conductors of two cables without preordering the conductors in the factory. In such a use, each conductor of one cable is positioned in one of a plurality of grooves which are formed in the base 60, each of which has sufficient depth to hold two conductors. A corresponding conductor of the second cable is positioned in each groove and the strain relief strip 63 is assembled to the base 60. Then the cover 100 is assembled to the base 60. The craftsperson causes the contact elements 62—62 to be moved to cause the conductors of the first cable and corresponding conductors of the second cable to be moved into the conductor-receiving slots 127—127 with ends of the contact elements being embedded in the cover.

The advantages of the system 50 of this invention are numerous. Neither separate conductor cut-off blades nor sophisticated tooling is required. The system 50 saves on materials and space requirements. For example, the connection of twenty-five pairs of conductors in prior art systems requires a connector length of about six to seven inches but only about three and a quarter inches in this system. This represents a reduction of about 50% and becomes significant with respect to requirements for closure sizes for example.

Another advantage relates to the capability of the contact elements to establish electrical connections between conductors of different gauge sizes and between two or more conductors in the same slot. Also, the connection between the conductors of the first and second groups is such that the connected conductors of each pair are contiguous to each other. This facilitates visual inspection and verification of conductor association in the factory or in the field.

It is to be understood that the above-described arrangements are simply illustrative of the invention. Other arrangements may be devised by those skilled in the art which will embody the principles of the invention and fall within the spirit and scope thereof.

What is claimed is:

1. A system for connecting electrically conductors of a first group with corresponding conductors of a second group, said system comprising:

a base which is made of a dielectric material and which includes a plurality of parallel grooves formed across one surface thereof for receiving individually the conductors of the first group, said base having a plurality of rows of apertures transverse of said grooves with adjacent apertures between said rows being staggered with respect to each other and with each of said apertures communicating with an associated groove;

a plurality of contact elements which are made of an electrically conductive material with each being positioned in an associated one of said apertures for establishing an electrical connection between conductors of the two groups, each contact element capable of being moved slidably in its associated aperture and comprising a tubular member having surfaces that define a conductor-receiving slot opening to and being aligned with the groove of said base that communicates with the aperture in which said each contact element is positioned, the slot being configured and the tubular member having sufficient stiffness to cause at least portions of the surfaces that define the slot to nick each conductor that is caused to be moved into and along the slot with any accompanying deflection of said surfaces being substantially negligible, and one end of each said contact element including a peripheral edge which has at least a portion thereof diametrically opposite to the conductor-receiving slot provided with a cutting edge that is effective to sever conductors that extend past the peripheral edge and that are moved into the slot; and means capable of being assembled to said base and of cooperating with said contact elements as said contact elements are moved within said associated apertures in said base for causing each conductor of the first group and a corresponding conductor of the second group which is aligned with each of said grooves to be moved into the slot of the contact element which is positioned in the associated aperture.

2. The system of claim 1, wherein said means is made of a dielectric material and includes a surface which covers said grooves and which because of the movement of said contact elements causes each conductor of the first group and its corresponding conductor of the second group to be moved into said slot of a contact element and which upon further movement of said contact elements causes one end of said contact element to become embedded in said means to move the conductors farther within said slot and to hold the conductors in said contact element.

3. The system of claim 1, wherein said tubular member has an inner diameter and an outer diameter, said inner diameter being at least slightly greater than the outer diameter of the wire-like conductive elements of insulated conductors that are moved into and along said slot.

4. The system of claim 3, wherein said tubular member is substantially linear and has a wall thickness which is less than the diameter of conductive elements of insulated conductors that are received in said slot and which is relatively large with respect to said inner diameter of said tubular member, and wherein said electrically conductive material has a relatively high modulus of elasticity.

5. The system of claim 1, wherein a conductor of the first group is positioned in each of said grooves of said base and said means includes a cover for holding the conductors of the first group in said grooves, and the relative motion is caused to occur by moving said contact elements into engagement with said cover subsequent to its assembly with said base to cause each conductor of the first group to be moved into said slot of a contact element, said cover being secured to said base by the embedment of one end of each of said contact elements therein.

6. The system of claim 5, wherein said cover includes a plurality of ribs, each said rib adapted to be received in an aligned groove of said base when said cover is mated with said base to cause each conductor in said groove to be moved into said conductor-receiving slot of said contact element.

7. The system of claim 5, wherein said means is made of a dielectric material and includes a carrier which is adapted to be assembled to said base and which includes a plurality of grooves formed across a surface of said carrier between partitions for receiving individually conductors of the second group, said grooves of said carrier being aligned with said grooves of said base when said carrier is assembled to said base, each conductor of the first group and the corresponding conductor of the second group being caused to be moved into said slot of one of said contact elements as said contact elements are moved into engagement with said carrier when said carrier is assembled to said base, said carrier being assembled to said base after said cover has been removed from said base, the conductors of the second group being caused to be moved into said slots of said contact elements as said contact elements are moved into engagement with said carrier after said carrier has been assembled to said base.

8. The system of claim 7, wherein said carrier also includes a plurality of pairs of holes which are arranged in two rows extending transversely of said grooves of said carrier and which extend into said surface of said carrier with adjacent points of each pair of said holes being spaced apart and being within one of said grooves, each pair of said holes forming a bridge along said groove of said carrier in which said adjacent points are located with each conductor of the second group spanning along one of said bridges, wherein when said carrier is assembled to said base, said bridges are effective to cause the conductors in said carrier to be moved into said conductor-receiving slots of said contact elements in said base and to cause the conductors of the first group which are positioned in said slots of said contact elements to be moved farther along in said slots.

9. The system of claim 8, wherein said holes are circular.

10. The system of claim 8, wherein said holes are semicircular with curved portions of each being adjacent to each other and spaced apart to form said bridge.

11. The system of claim 8, wherein said pairs of holes which are associated with each said groove in said carrier are formed to remove a portion of said partitions between which said each groove is formed to facilitate the embedment of said end of said contact element, which is aligned with said groove, in said carrier when said carrier is assembled to said base.

12. The system of claim 8, wherein said carrier is a first carrier and said system also includes a second carrier which is assembled to the surface of said base from which said contact elements protrude, said second carrier having a plurality of grooves for holding conductors of a third group, each said contact element including a conductor-receiving slot entry portion at each of its ends with the slots of each element being aligned with the grooves of said base and of each said carrier and the assembly of said second carrier with said base causing said other end of each said contact element to engage the conductor of the third group in the aligned groove of said second carrier.

13. The system of claim 8, wherein said carrier is provided with a strain relief strip which is adapted to engage each of the conductors of the second group between said contact elements and the second group and adapted to be secured to said carrier, said system also including a retainer strip which is adapted to be secured to said carrier to hold end portions of the conductors of the second group in engagement with said carrier prior to their connections with said contact elements, the end portions which extend past said bridges and which are held by said retainer strip destined to be severed during the connection of the conductors of the second group to the conductors of the first group.

14. The system of claim 13, wherein said carrier also includes a plurality of grooves along one side surface of the carrier and aligned with said grooves in said surface of the carrier, said retainer strip being adapted to be assembled to said carrier to cover said grooves in said side surface.

15. A method of connecting each conductor of a first group with a corresponding conductor of a second group, said method including the steps of:

positioning a conductor of the first group in each groove of a base which is made of a dielectric material and which includes a apertures and parallel grooves, the apertures being in rows which are transverse to the grooves with adjacent apertures between the rows being staggered with respect to each other and with each of the apertures communicating with one of the grooves, each of the apertures having a contact element positioned slidably therein with each contact element having surfaces that define a longitudinally extending conductor-receiving slot which is aligned with the groove that communicates with the aperture in which it is positioned, the slot being configured and the tubular member having sufficient stiffness to cause portions of the surfaces to nick each conductor that is caused to be moved into and along the slot with any accompanying deflection of the surfaces being substantially negligible, and wherein each contact element includes a cutting edge at one end of said slot;

holding the conductors of the first group in the grooves;

aligning a conductor of the second group with each groove in which the corresponding conductor of the first group is positioned; and moving each contact element through an incremental distance to cause the conductor of the first group in each groove and the aligned conductor of the second group to be moved into the slot of the contact element which is positioned in the aperture that communicates with the groove.

16. The method of claim 15, wherein said step of holding includes covering the conductors of the first group by assembling a cover to the base and as the contact elements are moved through the incremental distance, the conductors of the first group are caused to be moved into the slots thereof and to penetrate the cover, the penetration by ends of the contact elements causing the conductors to be moved farther into the slots.

17. The method of claim 16, wherein the incremental distance is a first incremental distance and which also includes the steps of positioning each of the conductors of a second group in a groove of a carrier with each conductor in each groove having a portion which is supported on a bridge, uncovering the conductors of the first group and assembling the carrier to the base with the conductors of the second group being aligned and adjacent to the conductors of the first group, and further moving the contact elements through a second incremental distance to cause the end of each to be moved over a bridge to sever an end portion of the conductor of the second group and to cause each conductor of the second group to be received in the conductor-receiving slot and moved therealong to move the conductor of the first group farther into the slot.

18. The method of claim 16, wherein each conductor of a first group is positioned in a groove of the base and each conductor of a second group that is to be connected to a corresponding conductor of the first group is positioned in the groove of the base with its corresponding conductor and the cover positioned over the conductors and the contact elements moved within the apertures to move ends into the grooves and to cause each conductor of the first and corresponding conductor of the second group to be moved into the conductor-receiving slot of the contact element which protrudes into the groove.

* * * * *